US010249317B2

(12) United States Patent
Schubert et al.

(10) Patent No.: US 10,249,317 B2
(45) Date of Patent: Apr. 2, 2019

(54) ESTIMATING NOISE OF AN AUDIO SIGNAL IN A LOG2-DOMAIN

(71) Applicant: Fraunhofer-Gesellschaft zur Foerderung der angewandten Forschung e.V., Munich (DE)

(72) Inventors: Benjamin Schubert, Nuremberg (DE); Manuel Jander, Hemhofen (DE); Anthony Lombard, Erlangen (DE); Martin Dietz, Nuremberg (DE); Markus Multrus, Nuremberg (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 87 days.

(21) Appl. No.: 15/417,234

(22) Filed: Jan. 27, 2017

(65) Prior Publication Data

US 2017/0133031 A1 May 11, 2017

Related U.S. Application Data

(63) Continuation of application No. PCT/EP2015/066657, filed on Jul. 24, 2015.

(30) Foreign Application Priority Data

Jul. 28, 2014 (EP) ..... 14178779

(51) Int. Cl.
*G10L 19/032* (2013.01)
*G10L 21/0216* (2013.01)
(Continued)

(52) U.S. Cl.
CPC ..... *G10L 21/0232* (2013.01); *G10L 21/038* (2013.01); *G10L 25/03* (2013.01);
(Continued)

(58) Field of Classification Search
CPC ..... G10L 19/012; G10L 19/02; G10L 19/032; G10L 21/0216; G10L 25/21
(Continued)

(56) References Cited

U.S. PATENT DOCUMENTS 4,630,304 A 12/1986 Borth et al.
5,227,788 A * 7/1993 Johnston et al.
(Continued)

FOREIGN PATENT DOCUMENTS

AU 724111 B2 9/2000
EP 1990799 A1 11/2008
(Continued)

OTHER PUBLICATIONS

De Wet, F. et al., "Additive Background Noise as a Source of Non-Linear Mismatch in the Cepstral and Log-Energy Domain", Computer Speech and Language, vol. 19, No. 1, Feb. 24, 2004, pp. 31-54.

(Continued)

*Primary Examiner* — Martin Lerner
(74) *Attorney, Agent, or Firm* — Perkins Coie LLP; Michael A. Glenn

(57) ABSTRACT

A method is described that estimates noise in an audio signal. An energy value for the audio signal is estimated and converted into the logarithmic domain. A noise level for the audio signal is estimated based on the converted energy value.

13 Claims, 3 Drawing Sheets

(51) Int. Cl.

| | |
|---|---|
| ***G10L 25/21*** | (2013.01) |
| ***G10L 21/0232*** | (2013.01) |
| ***G10L 25/03*** | (2013.01) |
| ***G10L 21/038*** | (2013.01) |
| *G10L 19/012* | (2013.01) |

(52) U.S. Cl.
CPC ..... *G10L 25/21* (2013.01); *G10L 19/012* (2013.01); *G10L 21/0216* (2013.01)

(58) Field of Classification Search
USPC ..... 704/200.1, 205, 226, 227, 230, 500, 501
See application file for complete search history.

(56) References Cited

U.S. PATENT DOCUMENTS

| | | | | |
|---|---|---|---|---|
| 6,131,083 | A * | 10/2000 | Miseki et al. | |
| 6,289,309 | B1 * | 9/2001 | DeVries | |
| 7,649,988 | B2 * | 1/2010 | Suppappola et al. | |
| 7,650,277 | B2 * | 1/2010 | Prakash | G10L 19/035 704/200.1 |
| 7,873,511 | B2 | 1/2011 | Herre et al. | |
| 2002/0152085 | A1 * | 10/2002 | Tsushima et al. | |
| 2003/0004720 | A1 * | 1/2003 | Garudadri et al. | |
| 2006/0007985 | A1 | 1/2006 | Larsson | |
| 2006/0074693 | A1 * | 4/2006 | Yamashita | |
| 2009/0281812 | A1 * | 11/2009 | Jung et al. | |
| 2009/0315748 | A1 | 12/2009 | Liljeryd et al. | |
| 2010/0184397 | A1 | 7/2010 | Kadous et al. | |

FOREIGN PATENT DOCUMENTS

| | | | |
|---|---|---|---|
| EP | 2573765 | A2 | 3/2013 |
| EP | 2717261 | A1 | 4/2014 |
| GB | 2216320 | A | 10/1989 |
| JP | S63500543 | A | 2/1988 |
| JP | 2008505557 | A | 2/2008 |
| JP | 2011521498 | A | 7/2011 |
| RU | 2163032 | C2 | 2/2001 |
| RU | 2226032 | C2 | 3/2004 |
| WO | 2011128138 | A1 | 10/2011 |
| WO | 2014020182 | A2 | 2/2014 |
| WO | 2014096279 | A1 | 6/2014 |
| WO | 2014096280 | A1 | 6/2014 |

OTHER PUBLICATIONS

Gerkmann, Timo et al., "Unbiased MMSE-Based Noise Power Estimation with Low Complexity and Low Tracking Delay", IEEE Transactions on Audio, Speech, and Language Processing, vol. 20, No. 4, May 2012, pp. 1-11.

Martin, R. , "Noise Power Spectral Density Estimation Based on Optimal Smoothing and Minimum Statistics", IEEE Transactions on Speech and Audio Processing, vol. 9, No. 5, Jul. 2001, pp. 504-512.

Rotaru, M. et al., "An Efficient GSC VSS-APA Beamformer with Integrated Log-Energy Based VAD for Noise Reduction in Speech Reinforcement Systems", International Symposium on Signals, Circuits and Systems, Jul. 11, 2013, 4 pages.

Turner, C.S. , "A Fast Binary Logarithm Algorithm", IEEE Signal Processing Magazine, Sep. 2010, pp. 124-125.

* cited by examiner

ESTIMATING NOISE OF AN AUDIO SIGNAL IN A LOG2-DOMAIN

CROSS-REFERENCE TO RELATED APPLICATIONS

This application is a continuation of copending International Application No. PCT/EP2015/066657, filed Jul. 21, 2015, which is incorporated herein by reference in its entirety, and additionally claims priority from European Application No. 14178779.6, filed Jul. 28, 2014, which is also incorporated herein by reference in its entirety.

BACKGROUND OF THE INVENTION

The present invention relates to the field of processing audio signals, more specifically to an approach for estimating noise in an audio signal, for example in an audio signal to be encoded or in an audio signal that has been decoded. Embodiments describe a method for estimating noise in an audio signal, a noise estimator, an audio encoder, an audio decoder and a system for transmitting audio signals.

In the field of processing audio signals, for example for encoding audio signals or for processing decoded audio signals, there are situations where it is desired to estimate the noise. For example, PCT/EP2013/077525 and PCT/EP2013/077527, incorporated herein by reference, describe using a noise estimator, for example a minimum statistics noise estimator, to estimate the spectrum of the background noise in the frequency domain. The signal that is fed into the algorithm has been transformed blockwise into the frequency domain, for example by a Fast Fourier transformation (FFT) or any other suitable filterbank. The framing is usually identical to the framing of the codec, i.e., the transforms already existing in the codec can be reused, for example in an EVS (Enhanced Voice Services) encoder the FFT used for the preprocessing. For the purpose of the noise estimation, the power spectrum of the FFT is computed. The spectrum is grouped into psychoacoustically motivated bands and the power spectral bins within a band are accumulated to form an energy value per band. Finally, a set of energy values is achieved by this approach which is also often used for psychoacoustically processing the audio signal. Each band has its own noise estimation algorithm, i.e., in each frame the energy value of that frame is processed using the noise estimation algorithm which analyzes the signal over time and gives an estimated noise level for each band at any given frame.

The sample resolution used for high quality speech and audio signals may be 16 bits, i.e., the signal has a signal-to-noise-ratio (SNR) of 96 dB. Computing the power spectrum means transforming the signal into the frequency domain and calculating the square of each frequency bin. Due to the square function, this necessitates a dynamic range of 32 bits. The summing up of several power spectrum bins into bands necessitates additional headroom for the dynamic range because the energy distribution within the band is actually unknown. As a result, a dynamic range of more than 32 bits, typically around 40 bits, needs to be supported to run the noise estimator on a processor.

In devices processing audio signals which operate on the basis of energy received from an energy storage unit, like a battery, for example portable devices like mobile phones, for preserving energy a power efficient processing of the audio signals is essential for the battery lifetime. In accordance with known approaches, the processing of audio signals is performed by fixed point processors which, typically, support processing of data in a 16 or 32 bit fixed point format. The lowest complexity for the processing is achieved by processing 16 bit data, while processing 32 bit data already necessitates some overhead. Processing data with 40 bits dynamic range necessitates splitting the data into two, namely a mantissa and an exponent, both of which must be dealt with when modifying the data which, in turn, results in an even higher computational complexity and even higher storage demands.

Starting from the known technology discussed above, it is an object of the present invention to provide for an approach for estimating the noise in an audio signal in an efficient way using a fixed point processor for avoiding unnecessary computational overhead.

SUMMARY

According to an embodiment, a method for estimating noise in an audio signal may have the steps of: determining an energy value for the audio signal; converting the energy value into the log 2-domain; and estimating a noise level for the audio signal based on the converted energy value directly in the log 2-domain, wherein the energy value is converted into the log 2-domain as follows:

$$E_{n_log} = \frac{\lfloor(\log_2(1 + E_{n_lin})) \cdot 2^N\rfloor}{2^N}$$

$\lfloor x \rfloor$ floor (x),
$E_{n_log}$ energy value of band n in the log 2-domain,
$E_{n_lin}$ energy value of band n in the linear domain,
N quantization resolution Another embodiment may have a non-transitory digital storage medium having stored thereon a computer program for performing a method for estimating noise in an audio signal, the method having: determining an energy value for the audio signal; converting the energy value into the log 2-domain; and estimating a noise level for the audio signal based on the converted energy value directly in the log 2-domain, wherein the energy value is converted into the log 2-domain as follows:

$$E_{n_log} = \frac{\lfloor(\log_2(1 + E_{n_lin})) \cdot 2^N\rfloor}{2^N}$$

$\lfloor x \rfloor$ floor (x),
$E_{n_log}$ energy value of band n in the log 2-domain,
$E_{n_lin}$ energy value of band n in the linear domain,
N quantization resolution,
when said computer program is run by a computer.

According to another embodiment, a noise estimator may have: a detector configured to determine an energy value for the audio signal; a converter configured to convert the energy value into the log 2-domain; and an estimator configured to estimate a noise level for the audio signal based on the converted energy value directly in the log 2-domain, wherein the energy value is converted into the log 2-domain as follows:

$$E_{n_log} = \frac{\lfloor(\log_2(1 + E_{n_lin})) \cdot 2^N\rfloor}{2^N}$$

$\lfloor x \rfloor$ floor (x), $E_{n_log}$ energy value of band n in the log 2-domain, $E_{n_lin}$ energy value of band n in the linear domain, N quantization resolution.

According to still another embodiment, an audio encoder may have a noise estimator as mentioned above.

According to another embodiment, an audio decoder may have a noise estimator as mentioned above.

According to another embodiment, a system for transmitting audio signals may have: an audio encoder configured to generate coded audio signal based on a received audio signal; and an audio decoder configured to receive the coded audio signal, to decode the coded audio signal, and to output the decoded audio signal, wherein at least one of the audio encoder and the audio decoder has a noise estimator as mentioned above.

The present invention provides a method for estimating noise in an audio signal, the method comprising determining an energy value for the audio signal, converting the energy value into the logarithmic domain, and estimating a noise level for the audio signal based on the converted energy value.

The present invention provides a noise estimator, comprising a detector configured to determine an energy value for the audio signal, a converter configured to convert the energy value into the logarithmic domain, and an estimator configured to estimate a noise level for the audio signal based on the converted energy value.

The present invention provides a noise estimator configured to operate according to the inventive method.

In accordance with embodiments the logarithmic domain comprises the log 2-domain.

In accordance with embodiments estimating the noise level comprises performing a predefined noise estimation algorithm on the basis of the converted energy value directly in the logarithmic domain. The noise estimation can be carried out based on the minimum statistics algorithm described by R. Martin, "Noise Power Spectral Density Estimation Based on Optimal Smoothing and Minimum Statistics", 2001. In other embodiments, alternative noise estimation algorithms can be used, like the MMSE-based noise estimator described by T. Gerkmann and R. C. Hendriks, "Unbiased MMSE-based noise power estimation with low complexity and low tracking delay", 2012, or the algorithm described by L. Lin, W. Holmes, and E. Ambikairajah, "Adaptive noise estimation algorithm for speech enhancement", 2003.

In accordance with embodiments determining the energy value comprises obtaining a power spectrum of the audio signal by transforming the audio signal into the frequency domain, grouping the power spectrum into psychoacoustically motivated bands, and accumulating the power spectral bins within a band to form an energy value for each band, wherein the energy value for each band is converted into the logarithmic domain, and wherein a noise level is estimated for each band based on the corresponding converted energy value.

In accordance with embodiments the audio signal comprises a plurality of frames, and for each frame the energy value is determined and converted into the logarithmic domain, and the noise level is estimated for each band based on the converted energy value.

In accordance with embodiments the energy value is converted into the logarithmic domain as follows:

$$E_{n_log} = \frac{\lfloor (\log_2(1 + E_{n_lin})) \cdot 2^N \rfloor}{2^N}$$

$\lfloor x \rfloor$ floor (x), $E_{n_log}$ energy value of band n in the log 2-domain, $E_{n_lin}$ energy value of band n in the linear domain, N resolution/precision.

In accordance with embodiments estimating the noise level based on the converted energy value yields logarithmic data, and the method further comprises using the logarithmic data directly for further processing, or converting the logarithmic data back into the linear domain for further processing.

In accordance with embodiments the logarithmic data is converted directly into transmission data, in case a transmission is done in the logarithmic domain, and converting the logarithmic data directly into transmission data uses a shift function together with a lookup table or an approximation, e.g., $$E_{n_lin} = 2^{(E_{n_log} - 1)}.$$

The present invention provides a non-transitory computer program product comprising a computer readable medium storing instructions which, when executed on a computer, carry out the inventive method.

The present invention provides an audio encoder, comprising the inventive noise estimator.

The present invention provides an audio decoder, comprising the inventive noise estimator.

The present invention provides a system for transmitting audio signals, the system comprising an audio encoder configured to generate coded audio signal based on a received audio signal, and an audio decoder configured to receive the coded audio signal, to decode the coded audio signal, and to output the decoded audio signal, wherein at least one of the audio encoder and the audio decoder comprises the inventive noise estimator.

The present invention is based on the inventors' findings that, contrary to conventional approaches in which a noise estimation algorithm is run on linear energy data, for the purpose of estimating noise levels in audio/speech material, it is possible to run the algorithm also on the basis of logarithmic input data. For the noise estimation the demand on data precision is not very high, for example when using estimated values for comfort noise generation as described in PCT/EP2013/077525 or PCT/EP2013/077527, both being incorporated herein by reference, it has been found that it is sufficient to estimate a roughly correct noise level per band, i.e., whether the noise level is estimated to be, e.g., 0.1 dB higher or not will not be noticeable in the final signal. Thus, while 40 bits may be needed to cover the dynamic range of the data, the data precision for mid/high level signals, in conventional approaches, is much higher than actually necessitated. On the basis of these findings, in accordance with embodiments, the key element of the invention is to convert the energy value per band into the logarithmic domain, advantageously the log 2-domain, and to carry out the noise estimation, for example on the basis of the minimum statistics algorithm or any other suitable algorithm, directly in a logarithmic domain which allows expressing the energy values in 16 bits which, in turn, allows for a more efficient processing, for example using a fixed point processor.

BRIEF DESCRIPTION OF THE DRAWINGS

Embodiments of the present invention will be described below with reference to the accompanying drawings, in which.

DETAILED DESCRIPTION OF THE INVENTION

In the following, embodiments of the inventive approach will be described in further detail and it is noted that in the accompanying drawing elements having the same or similar functionality are denoted by the same reference signs.

Figure 1:
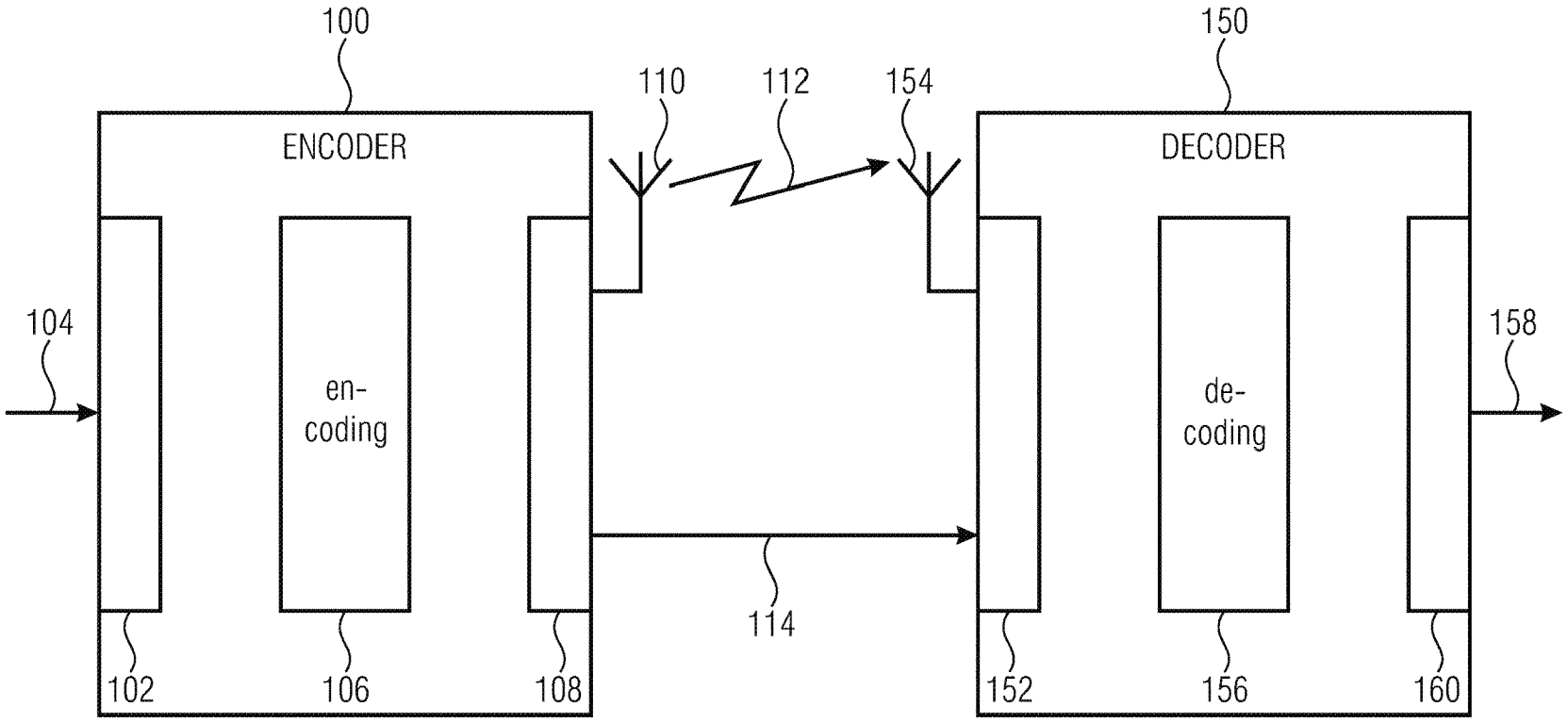
FIG. 1 shows a simplified block diagram of a system for transmitting audio signals implementing the inventive approach for estimating noise in an audio signal to encoded or in a decoded audio signal.

FIG. 1 shows a simplified block diagram of a system for transmitting audio signals implementing the inventive approach at the encoder side and/or at the decoder side. The system of FIG. 1 comprises an encoder 100 receiving at an input 102 an audio signal 104. The encoder includes an encoding processor 106 receiving the audio signal 104 and generating an encoded audio signal that is provided at an output 108 of the encoder. The encoding processor may be programmed or built for processing consecutive audio frames of the audio signal and for implementing the inventive approach for estimating noise in the audio signal 104 to be encoded. In other embodiments the encoder does not need to be part of a transmission system, however, it can be a standalone device generating encoded audio signals or it may be part of an audio signal transmitter. In accordance with an embodiment, the encoder 100 may comprise an antenna 110 to allow for a wireless transmission of the audio signal, as is indicated at 112. In other embodiments, the encoder 100 may output the encoded audio signal provided at the output 108 using a wired connection line, as it is for example indicated at reference sign 114.

The system of FIG. 1 further comprises a decoder 150 having an input 152 receiving an encoded audio signal to be processed by the decoder 150, e.g. via the wired line 114 or via an antenna 154. The decoder 150 comprises a decoding processor 156 operating on the encoded signal and providing a decoded audio signal 158 at an output 160. The decoding processor may be programmed or built for implementing the inventive approach for estimating noise in the decoded audio signal 104. In other embodiments the decoder does not need to be part of a transmission system, rather, it may be a standalone device for decoding encoded audio signals or it may be part of an audio signal receiver.

Figure 2:
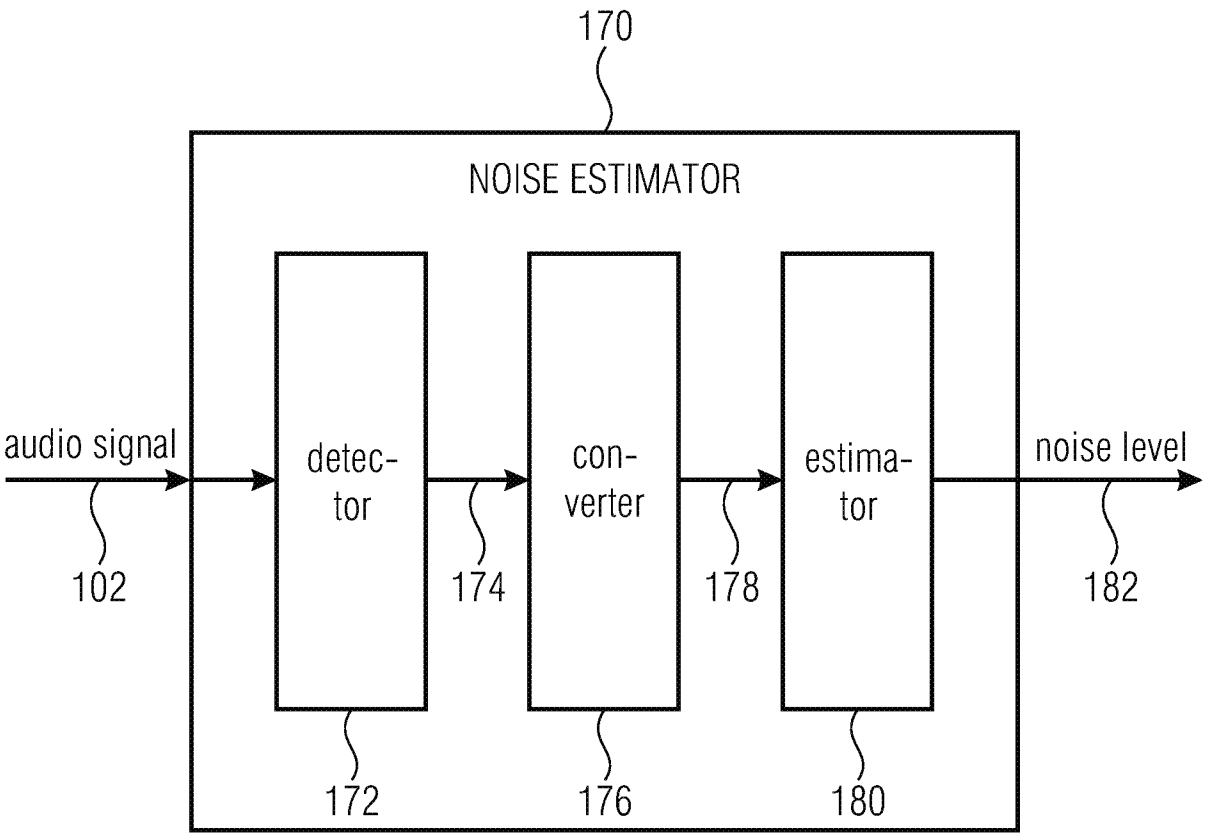
FIG. 2 shows a simplified block diagram of a noise estimator in accordance with an embodiment that may be used in an audio signal encoder and/or an audio signal decoder.

FIG. 2 shows a simplified block diagram of a noise estimator 170 in accordance with an embodiment. The noise estimator 170 may be used in an audio signal encoder and/or an audio signal decoder shown in FIG. 1. The noise estimator 170 includes a detector 172 for determining an energy value 174 for the audio signal 102, a converter 176 for converting the energy value 174 into the logarithmic domain (see converted energy value 178), and an estimator 180 for estimating a noise level 182 for the audio signal 102 based on the converted energy value 178. The estimator 170 may be implemented by common processor or by a plurality of processors programmed or build for implementing the functionality of the detector 172, the converter 176 and the estimator 180.

In the following, embodiments of the inventive approach that may be implemented in at least one of the encoding processor 106 and the decoding processor 156 of FIG. 1, or by the estimator 170 of FIG. 2 will be described in further detail.

Figure 3:
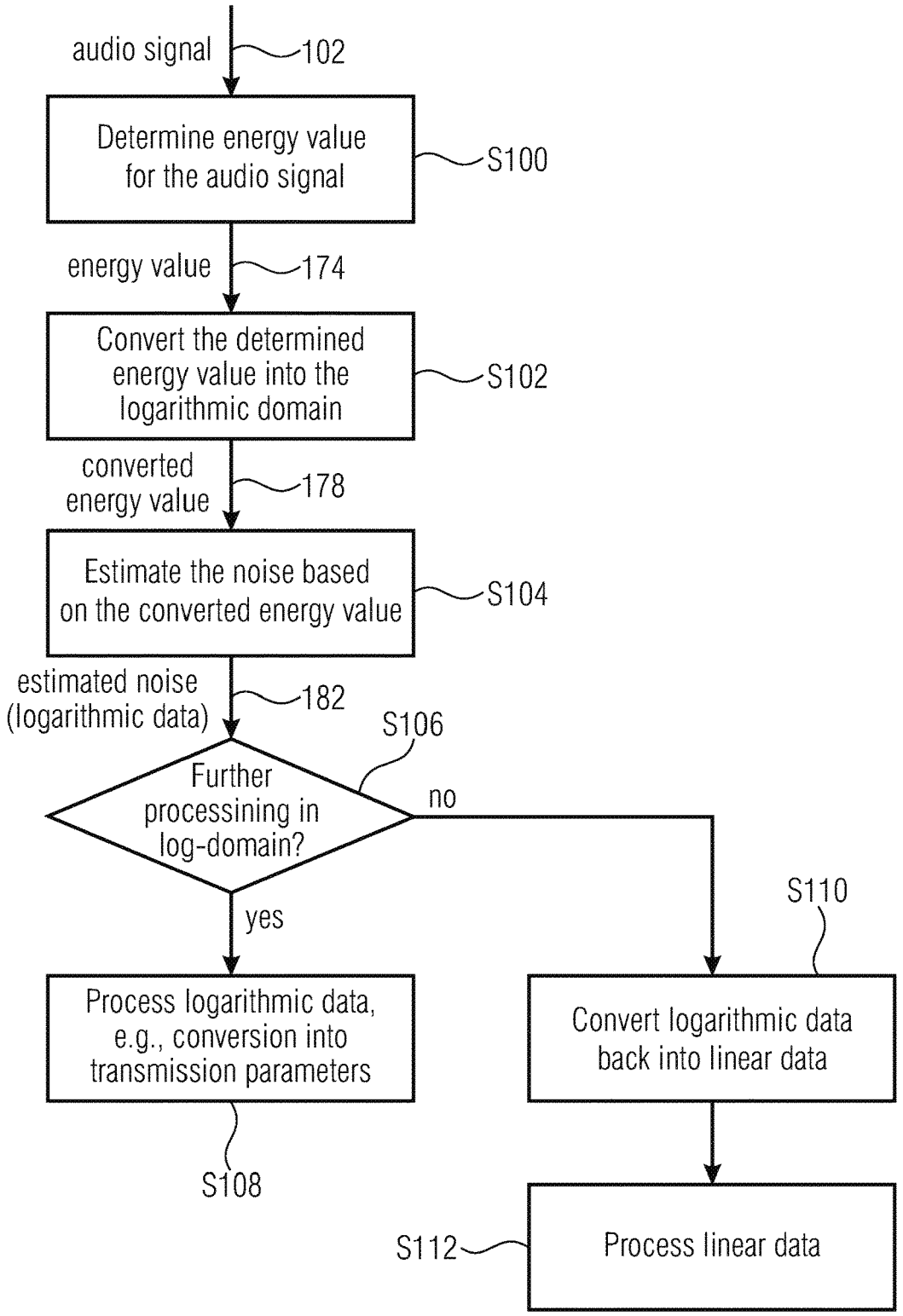
FIG. 3 shows a flow diagram depicting the inventive approach for estimating noise in an audio signal in accordance with an embodiment.

FIG. 3 shows a flow diagram of the inventive approach for estimating noise in an audio signal. An audio signal is received and, in a first step S100 an energy value 174 for the audio signal is determined, which is then, in step S102, converted into the logarithmic domain. On the basis of the converted energy value 178, in step S104, the noise is estimated. In accordance with embodiments, in step S106 it is determined as to whether further processing of the estimated noise data, which is represented by logarithmic data 182, should be in the logarithmic domain or not. In case further processing in the logarithmic domain is desired (yes in step S106), the logarithmic data representing the estimated noise is processed in step S108, for example the logarithmic data is converted into transmission parameters in case transmission occurs also in the logarithmic domain. Otherwise (no in step S106), the logarithmic data 182, is converted back into linear data in step S110, and the linear data is processed in step S112.

In accordance with embodiments, in step S100, determining the energy value for the audio signal may be done as in conventional approaches. The power spectrum of the FFT, which has been applied to the audio signal, is computed and grouped into psychoacoustically motivated bands. The power spectral bins within a band are accumulated to form an energy value per band so that a set of energy values is obtained. In other embodiments, the power spectrum can be computed based on any suitable spectral transformation, like the MDCT (Modified Discrete Cosine Transform), a CLDFB (Complex Low-Delay Filterbank), or a combination of several transformations covering different parts of the spectrum. In step S100 the energy value 174 for each band is determined, and the energy value 174 for each band is converted into the logarithmic domain in step S102, in accordance with embodiments, into the log 2-domain. The band energies may be converted into the log 2-domain as follows:

$$E_{n_log} = \frac{\lfloor (\log_2(1 + E_{n_lin})) \cdot 2^N \rfloor}{2^N}$$

$\lfloor x \rfloor$ floor (x), $E_{n_log}$ energy value of band n in the log 2-domain, $E_{n_lin}$ energy value of band n in the linear domain, N resolution/precision.

In accordance with embodiments, the conversion into the log 2-domain is performed which is advantageous in that the (int)log 2 function can be usually calculated very quickly, for example in one cycle, on fixed point processors using the "norm" function which determines the number of leading zeroes in a fixed point number. Sometimes a higher precision than (int)log 2 is needed, which is expressed in the above formula by the constant N. This slightly higher precision can be achieved with a simple lookup table having the most significant bits after the norm instruction and an approximation, which are common approaches for achieving low complexity logarithm calculation when lower precision is acceptable. In the above formula, the constant "1" inside the log 2 function is added to ensure that the converted energies remain positive. In accordance with embodiments this may be important in case the noise estimator relies on a statistical model of the noise energy, as performing a noise estimation on negative values would violate such a model and would result in an unexpected behavior of the estimator.

In accordance with an embodiment, in the above formula N is set to 6, which is equivalent to $2^6$=64 bits of dynamic range. This is larger than the above described dynamic range of 40 bits and is, therefore, sufficient. For processing the data the goal is to use 16 bit data, which leaves 9 bits for the mantissa and one bit for the sign. Such a format is commonly denoted as a "6Q9" format. Alternatively, since only positive values may be considered, the sign bit can be avoided and used for the mantissa leaving a total of 10 bits for the mantissa, which is referred to as a "6Q10" format.

A detailed description of the minimum statistics algorithm can be found in R. Martin, "Noise Power Spectral Density Estimation Based on Optimal Smoothing and Minimum Statistics", 2001. It essentially consists in tracking the minima of a smoothed power spectrum over a sliding temporal window of a given length for each spectral band, typically over a couple of seconds. The algorithm also includes a bias compensation to improve the accuracy of the noise estimation. Moreover, to improve tracking of a time-varying noise, local minima computed over a much shorter temporal window can be used instead of the original minima, provided that it yields a moderate increase of the estimated noise energies. The tolerated amount of increase is determined in R. Martin, "Noise Power Spectral Density Estimation Based on Optimal Smoothing and Minimum Statistics, 2001 by the parameter noise_slope_max. In accordance with an embodiment the minimum statistics noise estimation algorithm is used which, conventionally, runs on linear energy data. However, in accordance with the inventors' findings, for the purpose of estimating noise levels in audio material or speech material, the algorithm can be fed with logarithmic input data instead. While the signal processing itself remains unmodified, only a minimum of retunings are necessitated, which consists in decreasing the parameter noise_slope_max to cope with the reduced dynamic range of the logarithmic data compared to linear data. So far, it was assumed that the minimum statistics algorithm, or other suitable noise estimation techniques, needs to be run on linear data, i.e., data that in reality is a logarithmic representation was assumed not suitable. Contrary to this conventional assumption, the inventors found that the noise estimation can indeed be run on the basis of logarithmic data which allows using input data that is only represented in 16 bits which, as a consequence, provides for a much lower complexity in fixed point implementations as most operations can be done in 16 bits and only some parts of the algorithm still necessitate 32 bits. In the minimum statistics algorithm, for instance, the bias compensation is based on the variance of the input power, hence a fourth-order statistics which typically still necessitate a 32 bit representation.

As has been described above with regard to FIG. 3, the result of the noise estimation process can be further processed in different ways. In accordance with embodiments, a first way is to use the logarithmic data 182 directly, as is shown in step S108, for example by directly converting the logarithmic data 182 into transmission parameters if these parameters are transmitted in the logarithmic domain as well, which is often the case. A second way is to process the logarithmic data 182 such that it is converted back into the linear domain for further processing, for example using shift functions which are usually very fast and typically necessitate only one cycle on a processor, together with a table lookup or by using an approximation, for example:

$$E_{n_lin} = 2^{(E_{n_log}-1)}$$

In the following, a detailed example for implementing the inventive approach for estimating noise on the basis of logarithmic data will be described with reference to an encoder, however, as outlined above, the inventive approach can also be applied to signals which have been decoded in a decoder, as it is for example described in PCT/EP2013/077525 or PCT/EP2013/077527, both being incorporated herein by reference. The following embodiment describes an implementation of the inventive approach for estimating the noise in an audio signal in an audio encoder, like the encoder 100 in FIG. 1. More specifically, a description of a signal processing algorithm of an Enhanced Voice Services coder (EVS coder) for implementing the inventive approach for estimating the noise in an audio signal received at the EVS encoder will be given.

Input blocks of audio samples of 20 ms length are assumed in the 16 bit uniform PCM (Pulse Code Modulation) format. Four sampling rates are assumed, e.g., 8 000, 16 000, 32 000 and 48 000 samples/s and the bit rates for the encoded bit stream of may be 5.9, 7.2, 8.0, 9.6, 13.2, 16.4, 24.4, 32.0, 48.0, 64.0 or 128.0 kbit/s. An AMR-WB (Adaptive Multi Rate Wideband (codec)) interoperable mode may also be provided which operates at bit rates for the encoded bit stream of 6.6, 8.85, 12.65, 14.85, 15.85, 18.25, 19.85, 23.05 or 23.85 kbit/s.

For the purposes of the following description, the following conventions apply to the mathematical expressions:

$\lfloor x \rfloor$ indicates the largest integer less than or equal to x: $\lfloor 1.1 \rfloor=1$, $\lfloor 1.0 \rfloor=1$ and $\lfloor -1.1 \rfloor=-2$;

$\Sigma$ indicates a summation;

Unless otherwise specified, log(x) denotes logarithm at the base 10 throughout the following description.

The encoder accepts fullband (FB), superwideband (SWB), wideband (WB) or narrow-band (NB) signals sampled at 48, 32, 16 or 8 kHz. Similarly, the decoder output can be 48, 32, 16 or 8 kHz, FB, SWB, WB or NB. The parameter R (8, 16, 32 or 48) is used to indicate the input sampling rate at the encoder or the output sampling rate at the decoder The input signal is processed using 20 ms frames. The codec delay depends on the sampling rate of the input and output. For WB input and WB output, the overall algorithmic delay is 42.875 ms. It consists of one 20 ms frame, 1.875 ms delay of input and output re-sampling filters, 10 ms for the encoder look-ahead, 1 ms of post-filtering delay, and 10 ms at the decoder to allow for the overlap add operation of higher-layer transform coding. For NB input and NB output, higher layers are not used, but the 10 ms decoder delay is used to improve the codec performance in the presence of frame erasures and for music signals. The overall algorithmic delay for NB input and NB output is 43.875 ms-one 20 ms frame, 2 ms for the input re-sampling filter, 10 ms for the encoder look ahead, 1.875 ms for the output re-sampling filter, and 10 ms delay in the decoder. If the output is limited to layer 2, the codec delay can be reduced by 10 ms.

The general functionality of the encoder comprises the following processing sections: common processing, CELP (Code-Excited Linear Prediction) coding mode, MDCT (Modified Discrete Cosine Transform) coding mode, switching coding modes, frame erasure concealment side information, DTX/CNG (Discontinuous Transmission/Comfort Noise Generator) operation, AMR-WB-interoperable option, and channel aware encoding.

In accordance with the present embodiment, the inventive approach is implemented in the DTX/CNG operation section. The codec is equipped with a signal activity detection (SAD) algorithm for classifying each input frame as active or inactive. It supports a discontinuous transmission (DTX) operation in which a frequency-domain comfort noise generation (FD-CNG) module is used to approximate and update the statistics of the background noise at a variable bit rate. Thus, the transmission rate during inactive signal periods is variable and depends on the estimated level of the background noise. However, the CNG update rate can also be fixed by means of a command line parameter.

To be able to produce an artificial noise resembling the actual input background noise in terms of spectro-temporal characteristics, the FD-CNG makes use of a noise estimation algorithm to track the energy of the background noise present at the encoder input. The noise estimates are then transmitted as parameters in the form of SID (Silence Insertion Descriptor) frames to update the amplitude of the random sequences generated in each frequency band at the decoder side during inactive phases.

The FD-CNG noise estimator relies on a hybrid spectral analysis approach. Low frequencies corresponding to the core bandwidth are covered by a high-resolution FFT analysis, whereas the remaining higher frequencies are captured by a CLDFB which exhibits a significantly lower spectral resolution of 400 Hz. Note that the CLDFB is also used as a resampling tool to downsample the input signal to the core sampling rate.

The size of an SID frame is however limited in practice. To reduce the number of parameters describing the background noise, the input energies are averaged among groups of spectral bands called partitions in the sequel.

1. Spectral Partition Energies

The partition energies are computed separately for the FFT and CLDFB bands. The $L_{SID}^{[FFT]}$ energies corresponding to the FFT partitions and the $L_{SID}^{[CLDFB]}$ energies corresponding to the CLDFB partitions are then concatenated into a single array $E_{FD\text{-}CNG}$ of the size $L_{SID}=L_{SID}^{[FFT]}+L_{SID}^{[CLDFB]}$ which will serve as input to the noise estimator described below (see "2. FD-CNG Noise Estimation").

1.1 Computation of the FFT Partition Energies

Partition energies for the frequencies covering the core bandwidth are obtained as $$E_{FD\text{-}CNG}(i) = \frac{E_{CB}^{[0]}(i) + E_{CB}^{[1]}(i)}{2} H_{de\text{-}emph}(i) \quad i = 0, \ldots, L_{SID}^{[FFT]} - 1$$

where $E_{CB}^{[0]}(i)$ and $E_{CB}^{[1]}(i)$ are the average energies in critical band i for the first and second analysis windows, respectively. The number of FFT partitions $L_{SID}^{[FFT]}$ capturing the core bandwidth ranges between 17 and 21, according to the configuration used (see "1.3 FD-CNG encoder configurations"). The de-emphasis spectral weights $H_{de\text{-}emph}(i)$ are used to compensate for a high-pass filter and are defined as $$\{H_{de\text{-}emph}(0), \ldots, H_{de\text{-}emph}(L_{SID}^{[FFT]}-1)\} = \{9.7461, 9.5182, 9.0262, 8.3493, 7.5764, 6.7838, 5.8377, 4.8502, 4.0346, 3.2788, 2.6283, 2.0920, 1.6304, 1.2850, 1.0108, 0.7916, 0.6268, 0.5011, 0.4119, 0.3637\}.$$

1.2 Computation of the CLDFB Partition Energies

The partition energies for frequencies above the core bandwidth are computed as $$E_{FD\text{-}CNG}(i) = \frac{1}{16} \frac{1}{(A_{CLDFB})^2} \frac{\sum_{j=j_{min}(i)}^{j_{max}(i)} E_{CLDFB}(j)}{j_{max}(i) - j_{min}(i) + 1}$$

$$i = L_{SID}^{[FFT]}, \ldots, L_{SID}^{[FFT]} + L_{SID}^{[CLDFB]} - 1$$

where $j_{min}(i)$ and $j_{max}(i)$ are the indices of the first and last CLDFB bands in the i-th partition, respectively, $E_{CLDFB}(j)$ is the total energy of the j-th CLDFB band, and $A_{CLDFB}$ is a scaling factor. The constant 16 refers to the number of time slots in the CLDFB. The number of CLDFB partitions $L_{CLDFB}$ depends on the configuration used, as described below.

1.3 FD-CNG Encoder Configurations

The following table lists the number of partitions and their upper boundaries for the different FD-CNG configurations at the encoder.

TABLE 1

Configurations of the FD-CNG noise estimation at the encoder

| | Bit-rates [kbps] | $L_{SID}^{[FFT]}$ | $L_{SID}^{[CLDFB]}$ | $f_{max}(i)$, i = 0, . . . , $L_{SID}^{[FFT]}$ − 1 [Hz] | $f_{max}(i)$, i = $L_{SID}^{[FFT]}$, . . . , $L_{SID}$ − 1 [Hz] |
|---|---|---|---|---|---|
| NB | • | 17 | 0 | 100, 200, 300, 400, 500, 600, 750, 900, 1050, 1250, 1450, 1700, 2000, 2300, 2700, 3150, 3975 | x |
| WB | ≤8 | 20 | 0 | 100, 200, 300, 400, 500, 600, 750, 900, 1050, 1250, 1450, 1700, 2000, 2300, 2700, 3150, 3700, 4400, 5300, 6375 | x |
| | 8 < • ≤ 13.2 | 20 | 1 | 100, 200, 300, 400, 500, 600, 750, 900, 1050, 1250, 1450, 1700, 2000, 2300, 2700, 3150, 3700, 4400, 5300, 6375 | 8000 |
| | >13.2 | 21 | 0 | 100, 200, 300, 400, 500, 600, | x |

TABLE 1-continued

| Configurations of the FD-CNG noise estimation at the encoder | | | | | |
|---|---|---|---|---|---|
| | Bit-rates [kbps] | $L_{SID}^{[FFT]}$ | $L_{SID}^{[CLDFB]}$ | $f_{max}(i)$, $i = 0, \ldots, L_{SID}^{[FFT]} - 1$ [Hz] | $f_{max}(i)$, $i = L_{SID}^{[FFT]}, \ldots, L_{SID} - 1$ [Hz] |
| | | | | 750, 900, 1050, 1250, 1450, 1700, 2000, 2300, 2700, 3150, 3700, 4400, 5300, 6375, 7975 | |
| SW B/FB | ≤13.2 | 20 | 4 | 100, 200, 300, 400, 500, 600, 750, 900, 1050, 1250, 1450, 1700, 2000, 2300, 2700, 3150, 3700, 4400, 5300, 6375 | 8000, 10000, 12000, 14000 |
| | >13.2 | 21 | 3 | 100, 200, 300, 400, 500, 600, 750, 900, 1050, 1250, 1450, 1700, 2000, 2300, 2700, 3150, 3700, 4400, 5300, 6375, 7975 | 10000, 12000, 16000 |

For each partition i=0, . . . , $L_{SID}-1$, $f_{max}(i)$ corresponds to the frequency of the last band in the i-th partition. The indices $j_{min}(i)$ and $j_{max}(i)$ of the first and last bands in each spectral partition can be derived as a function of the configuration of the core as follows:

$$j_{max}(i) = \begin{cases} f_{max}(i)\dfrac{\text{core_FFT_length}}{\text{core_sampling_rate}} & i = 0, \ldots, L_{SID}^{[FFT]} - 1 \\ j_{max}(L_{SID}^{[FFT]} - 1) + \dfrac{2f_{max}(i) - \text{core_sampling_rate}}{800} & i = L_{SID}^{[FFT]}, \ldots, L_{SID} - 1 \end{cases},$$

$$j_{min}(i) = \begin{cases} f_{min}(0)\dfrac{\text{core_sampling_rate}}{\text{core_FFT_length}} & i = 0 \\ j_{max}(i-1) + 1 & i > 0 \end{cases},$$

where $f_{min}(0)$=50 Hz is the frequency of the first band in the first spectral partition. Hence the FD-CNG generates some comfort noise above 50 Hz only.

2. FD-CNG Noise Estimation

The FD-CNG relies on a noise estimator to track the energy of the background noise present in the input spectrum. This is based mostly on the minimum statistics algorithm described by R. Martin, "Noise Power Spectral Density Estimation Based on Optimal Smoothing and Minimum Statistics", 2001. However, to reduce the dynamic range of the input energies $\{E_{FD\text{-}CNG}(0), \ldots, E_{FD\text{-}CNG}(L_{SID}-1)\}$ and hence facilitate the fixed-point implementation of the noise estimation algorithm, a non-linear transform is applied before noise estimation (see "2.1 Dynamic range compression for the input energies"). The inverse transform is then used on the resulting noise estimates to recover the original dynamic range (see "2.3 Dynamic range expansion for the estimated noise energies").

2.1 Dynamic Range Compression for the Input Energies

The input energies are processed by a non-linear function and quantized with 9-bit resolution as follows:

$$E_{MS}(i) = \frac{\lfloor \log_2((1 + E_{FD-CNG}(i))2^9) \rfloor}{2^9} \quad i = 0, \ldots, L_{SID} - 1$$

2.2 Noise Tracking

A detailed description of the minimum statistics algorithm can be found in R. Martin, "Noise Power Spectral Density Estimation Based on Optimal Smoothing and Minimum Statistics", 2001. It essentially consists in tracking the minima of a smoothed power spectrum over a sliding temporal window of a given length for each spectral band, typically over a couple of seconds. The algorithm also includes a bias compensation to improve the accuracy of the noise estimation. Moreover, to improve tracking of a time-varying noise, local minima computed over a much shorter temporal window can be used instead of the original minima, provided that it yields a moderate increase of the estimated noise energies. The tolerated amount of increase is determined in R. Martin, "Noise Power Spectral Density Estimation Based on Optimal Smoothing and Minimum Statistics", 2001 by the parameter noise_slope_max.

The main outputs of the noise tracker are the noise estimates $N_{MS}(i)$, i=0, . . . , $L_{SID}-1$. To obtain smoother transitions in the comfort noise, a first-order recursive filter may be applied, i.e. $\overline{N}_{MS}(i)=0.95\overline{N}_{MS}(i)+0.05N_{MS}(i)$.

Furthermore, the input energy $E_{MS}(i)$ is averaged over the last 5 frames. This is used to apply an upper limit on $\overline{N}_{MS}(i)$ in each spectral partition.

2.3 Dynamic Range Expansion for the Estimated Noise Energies

The estimated noise energies are processed by a non-linear function to compensate for the dynamic range compression described above:

$$N_{FD\text{-}CNG}(i)=2^{\overline{N}_{MS}(i)-1} \quad i=L_{SID}-1.$$

In accordance with the present invention an improved approach for estimating noise in an audio signal is described which allows reducing the complexity of the noise estimator, especially for audio/speech signals which are processed on processors using fixed point arithmetic. The inventive approach allows reducing the dynamic range used for the noise estimator for audio/speech signal processing, e.g., in an environment described in PCT/EP2013/077525, which refers to the generation of a comfort noise with high spectra-temporal resolution, or in PCT/EP2013/077527, which refers to comfort noise addition for modeling background noise at low bit-rate. In the scenarios described, a noise estimator is used operating on the basis of the minimum statistic algorithm for enhancing the quality of background noise or for a comfort noise generation for noisy speech signals, for example speech in the presence of background noise which is a very common situation in a phone call and one of the tested categories of the EVS codec. The EVS codec, in accordance with the standardization, will use a processor with fixed arithmetic, and the inventive approach allows reducing the processing complexity by reducing the dynamic range of the signal that is used for the minimum statistics noise estimator by processing the energy value for the audio signal in the logarithmic domain and no longer in the linear domain.

Although some aspects of the described concept have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

Depending on certain implementation requirements, embodiments of the invention can be implemented in hardware or in software. The implementation can be performed using a digital storage medium, for example a floppy disk, a DVD, a Blue-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods may be performed by any hardware apparatus.

While this invention has been described in terms of several embodiments, there are alterations, permutations, and equivalents which will be apparent to others skilled in the art and which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. A method for estimating noise in an audio signal, the method comprising:

determining an energy value for the audio signal;

converting the energy value into the log 2-domain, and estimating a noise level for the audio signal based on the converted energy value directly in the log 2-domain, wherein the energy value is converted into the log 2-domain as follows:

$$E_{n_log} = \frac{\lfloor(\log_2(1 + E_{n_lin})) \cdot 2^N\rfloor}{2^N}$$

$\lfloor x \rfloor$ floor (x), $E_{n_log}$ energy value of band n in the log 2-domain, $E_{n_lin}$ energy value of band n in the linear domain, N quantization resolution.

2. The method of claim 1, wherein estimating the noise level comprises performing a predefined noise estimation algorithm.

3. The method of claim 2, wherein the predefined noise estimation algorithm comprises a minimum statistics algorithm.

4. The method of claim 1, wherein determining the energy value comprises acquiring a power spectrum of the audio signal by transforming the audio signal into the frequency domain, grouping the power spectrum into psychoacoustically motivated bands, and accumulating the power spectral bins within a band to form an energy value for each band, wherein the energy value for each band is converted into the log 2-domain, and wherein a noise level is estimated for each band based on the corresponding converted energy value.

5. The method of claim 4, wherein the audio signal comprises a plurality of frames, and wherein for each frame the energy value is determined and converted into the log 2-domain, and the noise level is estimated for each band of a frame based on the converted energy value.

6. The method of claim 1, wherein estimating the noise level based on the converted energy value yields logarithmic data, and wherein the method further comprises:

using the logarithmic data directly for further processing, or converting the logarithmic data back into the linear domain for further processing.

7. The method of claim 6, wherein the logarithmic data is converted directly into transmission data, in case a transmission is done in the logarithmic domain, and converting the logarithmic data directly into transmission data uses a shift function together with a lookup table or an approximation.

8. The method of claim 7, wherein the approximation comprises $$E_{n_lin} = 2^{(E_{n_log}-1)}.$$

9. A non-transitory digital storage medium having stored thereon a computer program for performing a method for estimating noise in an audio signal, the method comprising:

determining an energy value for the audio signal;

converting the energy value into the log 2-domain, and estimating a noise level for the audio signal based on the converted energy value directly in the log 2-domain, wherein the energy value is converted into the log 2-domain as follows:

$$E_{n_log} = \frac{\lfloor(\log_2(1 + E_{n_lin})) \cdot 2^N\rfloor}{2^N}$$

$\lfloor x \rfloor$ floor (x), $E_{n_log}$ energy value of band n in the log 2-domain, $E_{n_lin}$ energy value of band n in the linear domain, N quantization resolution, when said computer program is run by a computer.

10. A noise estimator apparatus, comprising:

a detector configured to determine an energy value for the audio signal;

a converter configured to convert the energy value into the log 2-domain; and an estimator apparatus configured to estimate a noise level for the audio signal based on the converted energy value directly in the log 2-domain, wherein the energy value is converted into the log 2-domain as follows:

$$E_{n_log} = \frac{\lfloor(\log_2(1 + E_{n_lin})) \cdot 2^N\rfloor}{2^N}$$

$\lfloor X \rfloor$ floor (x), $E_{n_log}$ energy value of band n in the log 2-domain, $E_{n_lin}$ energy value of band n in the linear domain, N quantization resolution.

11. An audio encoding apparatus, comprising a noise estimator apparatus of claim 10.

12. An audio decoding apparatus, comprising a noise estimator apparatus of claim 10.

13. A system for transmitting audio signals, the system comprising:

an audio encoding apparatus configured to generate coded audio signal based on a received audio signal; and an audio decoding apparatus configured to receive the coded audio signal, to decode the coded audio signal, and to output the decoded audio signal, wherein at least one of the audio encoding apparatus and the audio decoding apparatus comprises a noise estimator apparatus of claim 10.

* * * * *